United States Patent [19]

Avraham

[11] Patent Number: 4,773,549

[45] Date of Patent: Sep. 27, 1988

[54] REUSEABLE BOTTLE HOLDER

[76] Inventor: Yecheal A. Avraham, #218, 4444 Hazeltine Ave., Sherman Oaks, Calif. 91423

[21] Appl. No.: 77,511

[22] Filed: Jul. 24, 1987

[51] Int. Cl.[4] ..... B65D 23/10

[52] U.S. Cl. ..... 215/100 A; 220/85 H; 220/94 R; 294/27.1; 294/31.2; 294/33

[58] Field of Search ..... 215/100 A, 100 R; 220/94 R, 94 A, 85 H; D7/70; 294/27.1, 31.2, 33

[56] References Cited

U.S. PATENT DOCUMENTS

| | | | |
|---|---|---|---|
| D. 204,295 | 4/1966 | Brekke | D7/70 |
| 1,702,555 | 2/1929 | Watson | 220/85 H |
| 1,721,644 | 7/1929 | Souatkin | 215/100 R |
| 1,825,897 | 10/1931 | Brooke | 294/31.2 |
| 2,049,219 | 7/1936 | Muschinske et al. | 215/100 R X |
| 2,844,346 | 7/1958 | Six | 220/85 H X |
| 3,177,025 | 4/1965 | Short | 215/100 A X |
| 4,368,826 | 1/1983 | Thompson | 215/100 A |
| 4,379,578 | 4/1983 | Schuler | 294/33 X |
| 4,486,043 | 12/1984 | Rais | 215/100 A X |
| 4,627,546 | 12/1986 | Carranza | 220/94 R X |

FOREIGN PATENT DOCUMENTS

| | | | |
|---|---|---|---|
| 8302101 | 6/1983 | PCT Int'l Appl. | 215/100 A |
| 919799 | 2/1963 | United Kingdom | 215/100 A |

*Primary Examiner*—William Price
*Assistant Examiner*—Sue A. Weaver
*Attorney, Agent, or Firm*—Albert O. Cota

[57] ABSTRACT

A reuseable bottle holder (10) for attachment to a bottle (50) having a large diameter annular side wall (52) that tapers into a bottle neck (54) incorporating an annular neck flange (56). Because of their size, these bottles are typically handled with both hands. The handling problem is particularly difficult when pouring or when being handled by small children. The holder (10) consists of a horizontal section (16) that includes a bottle neck aperture (18) aligned with a bottle neck locking aperture (22) having an annular neck flange (26). On the front end of the horizontal section (16) is a front bottle support (12) that extends downwardly and on its back end is a handle (14). The holder (10) is attached to the bottle (50) by inserting the bottle neck into the aperture (18). The handle (14) is then gently pulled backwards to allow the bottle neck locking aperture (22) to lock onto the bottle neck (54) with the annular neck flange (56) seated on the annular neck flange channel (26). With the holder (10) attached, the bottle (50) can be easily lifted, carried or poured with one hand.

9 Claims, 2 Drawing Sheets

REUSEABLE BOTTLE HOLDER

TECHNICAL FIELD

The invention pertains to the general field of holders for containers and more particularly to a reuseable bottle holder specifically designed for conventional two-liter soft drink bottles.

BACKGROUND ART

Since the introduction of the economy, two-liter soft drink bottles, there has been a problem in grasping the bottle and pouring its contents into a cup. This problem exists primarily because the bottles have a diameter that makes the bottle difficult to grasp with one hand. The plastic material used in manufacturing the bottles also compounds the grasping problem. This plastic is thin and resilient and can easily collapse upon grasping—and, in many cases, the plastic is slippery due to the accumulated moisture. The weight of the full bottle also causes additional grasping problems especially for small children.

Because of the bottle design, there have been many instances where the bottle has slipped from the hand grip causing a spill, either when being poured or when the bottle is removed from or returned to the refrigerator.

In summary, to prevent spillage, it is usually necessary to use two hands to hold and pour from the bottle, especially when the bottle is full. When using both hands, it is impossible to steady the cup to prevent the cup from toppling when being filled.

A search of the prior art did not disclose any patents that read directly on the claims of the instant invention however, the following U.S. patents were considered related:

| U.S. PAT. NO. | INVENTOR | ISSUED |
|---|---|---|
| 4,627,546 | Carranza | 9 December 1986 |
| 4,486,043 | Rais | 4 December 1984 |
| 4,379,578 | Schuler | 12 April 1983 |
| 3,177,025 | Short | 6 April 1965 |

The Carranza patent discloses a flexible detachable handle and carrier for a plastic bottle. The device consists of a single two-ended piece of flat flexible material that attaches on its upper end to the bottle neck and on its lower end to the bottle bottom. Between the two ends of the material is formed a hand hold for carrying the bottle. The upper end of the device, features two partially overlapping nonconcentric openings. The first opening slips over the bottle neck and collar and the second snaps around the neck when the handle is tugged.

The Rais patent discloses a reuseable plastic bottle handle that allows the bottle to be lifted and manipulated to pour the contents of the bottle. The handle includes an extended upper section and a lower section. The upper end of the upper section has a hook-like projection that clamps to one side of the bottle's neck. The lower end of the lower section has a prong that is inserted between a cup-like base and the exterior wall of the bottle. Thus, the two ends secure the handle to the bottle.

The Schuler patent discloses a reuseable bottle holder adapted for use on bottles having a flange at the neck of the bottle. The holder has a locking position on its upper end that fits into and locks to the neck of the bottle by friction when the handle is extended outwardly. The bottom portion of the handle consists of a circular opening that fits around the lower end of the bottle.

Between the upper and lower portions is a handle portion that allows the bottle to be held.

The Short patent discloses a spring clip handle that is readily attached to, or detached from, a gas cylinder. The handle has on its upper-end a spring clip having parallel legs that grip the tubular neck of the cylinder. The lower end of the handle has a larger curved clip that attaches and grips the bottom of the cylinder.

DISCLOSURE OF THE INVENTION

The reuseable bottle holder is designed to provide a lightweight, compact handle that can be easily attached and detached from either a one or two-liter bottle. These bottles are typically used for soft drinks and are designed with a large diameter annular side wall that tapers upwardly into a bottle neck that incorporates an annular neck flange. The neck flange is used as a hand stop when carrying the bottle. Because of their size, the bottles are typically handled with both hands when liquid is being poured. If the cup is not held, which cannot be done if both hands are being used, to hold the bottle, a spillage, when the liquid enters the cup often occurs. If one hand is used to hold the cup while the other to hold the bottle a spillage can also occur because of the difficulty that is encountered in trying to hold the bottle with one hand.

The bottle holding and pouring problem is solved by using the inventive reuseable bottle holder. This holder, which is integrally formed of a plastic, consists of a horizontal section having attached to its front end, a front bottle support that extends downwardly and to its rear end, a handle section that also extends downwardly. The horizontal support has on its planar surface a set of aligned interfacing apertures—a bottleneck aperture and a bottle neck locking aperture having an annular neck flange channel.

To attach the holder to the bottle, the bottle neck is initially inserted into the bottle neck aperture. The handle is then grasped and gently pulled backwards, while holding the bottle, until the bottle neck locking aperture locks itself onto the bottle neck with the annular neck flange channel seated under the bottle's annular neck flange. The holding contact points of the holder occur at the annular neck flange and at the bottom section of the front bottle support.

In view of the above disclosure, the primary object of the invention is to provide a holder that easily attaches to a bottle to then allow the bottle to be easily lifted, carried and poured with one hand.

In addition to the primary object, it is also an object of the invention to have a holder that is:

sized to allow attachment to either a one or two-liter bottle, designed to allow the bottle, with the handle attached, to be easily placed and removed from a refrigerator or shelf and to reduce incidents of spillage, attractive and rugged, easily handled by small children, and suitable for the premium market.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
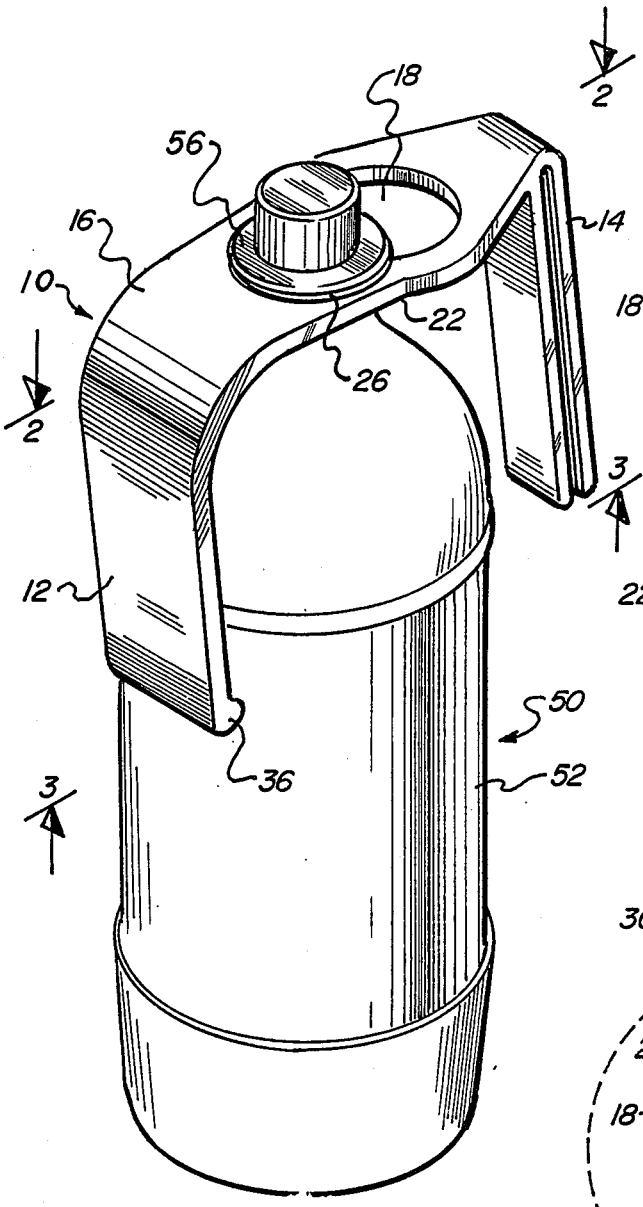
FIG. 1 is a perspective view of the reuseable bottle holder attached to a bottle.

The best mode for carrying out the reuseable bottle holder 10 is presented in terms of a preferred embodiment that is primarily designed to allow a soft drink bottle, such as the conventional two-liter bottle, to be easily lifted, carried and poured.

The preferred embodiment, as shown in FIGS. 1 through 7 is comprised of the following seven major elements: a front bottle support 12, a handle section 14, a horizontal section 16 that incorporates a bottle neck aperture 18, a bottle neck locking aperture 22, a set of locking flange projections 24 and an annular neck flange channel 26.

Figure 4:
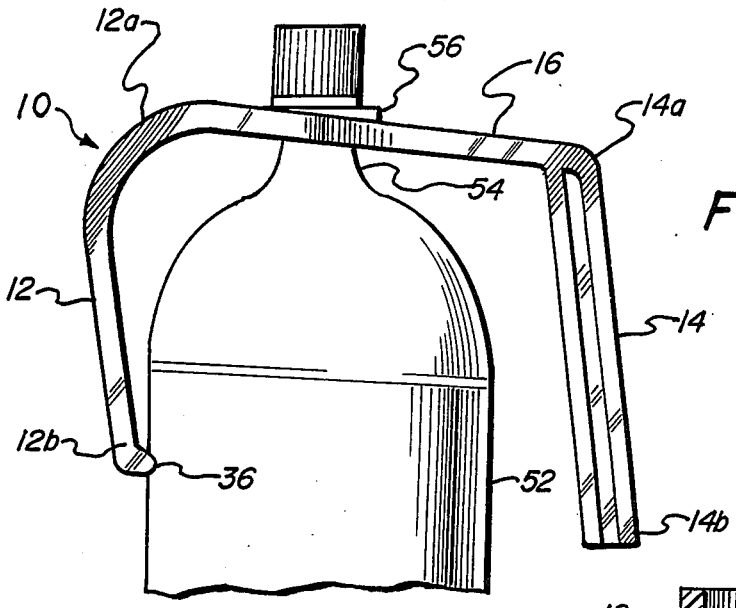
FIG. 4 is a side view of the basic holder attached to a bottle.
Figure 6:
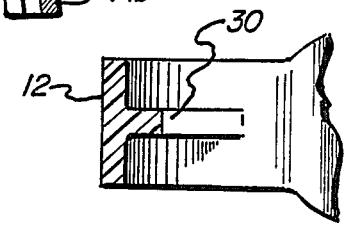
FIG. 6 is a bottom view of the front reinforcing rib taken along lines 6—6 of FIG. 5 partially cut away for clarity.

The basic configuration of the reuseable bottle holder 10 is shown attached to a bottle 50 in FIG. 1. The soft drink bottle, as best shown in FIG. 4, includes a relatively large diameter annular side wall 52 that terminates in a smaller diameter bottle neck 54. The neck is provided with an annular neck flange 56 above which is a set of threads that receive a cap for closing the bottle.

Figure 5:
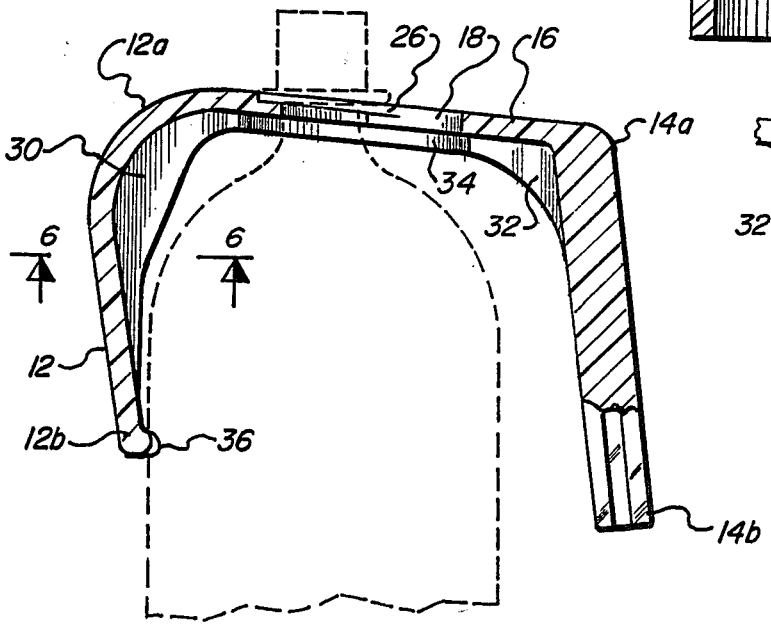
FIG. 5 is a side view of the holder with a front and back strengthening rib and an aperture reinforcing lip partially shown cut away in cross section.

The holder 10 in its basic configuration, as shown in FIGS. 1, 4 and 5 is comprised of the front bottle support 12 that has an upper end **12*a* and a lower end 12*b*; handle that also has an upper end 14*a* and a lower end 14*b*; and a horizontal section 16**.

Figure 3:
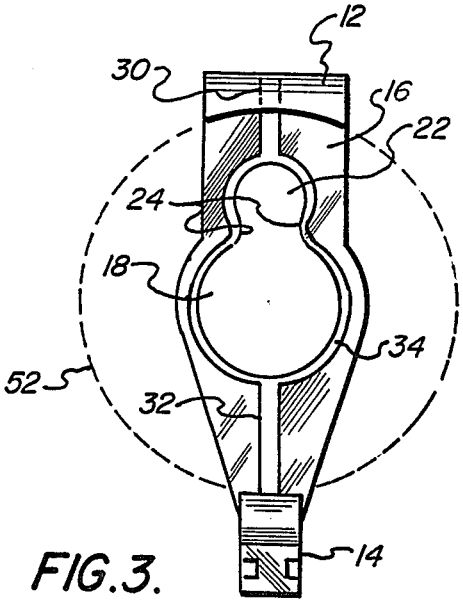
FIG. 3 is a bottom view of the holder taken along lines 3—3 of FIG. 1.

The front bottle support 12 may be designed with a bottom end that is straight, as shown in FIG. 1, or it may be radiused, as shown in FIG. 3, to fit the radial rounded surface of the bottle 50. Additionally, the bottom end may include a bottle grasping tip 36 as shown in FIGS. 1 and 5. The tip provides a more positive contact with the bottle's surface to add further stability to the holder 10.

Figure 7:
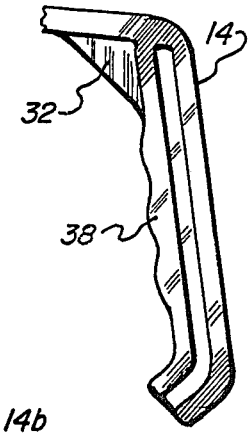
FIG. 7 is a side view of the handle with a finger grip contour.

The handle section 14 may be designed with a straight handle, as shown in FIG. 4, or with a finger grip contour 38, as shown in FIG. 7. The finger grip contour 38, allows a more positive grip to also further add to the holder's stability.

The horizontal section 16 has its front end contiguously attached to the upper end **12*a* of the front bottle support 12 while its back end is contiguously attached to the upper end 14*a* of the handle 14**.

Figure 2:
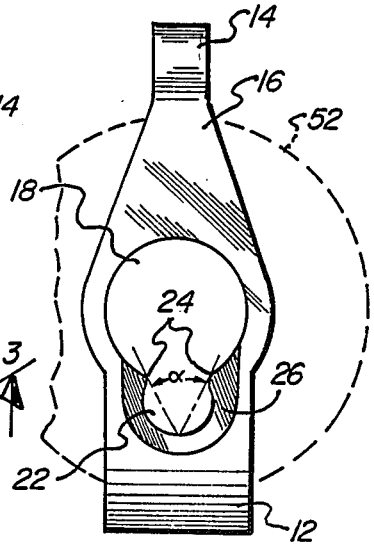
FIG. 2 is a top view of the holder taken along lines 2—2 of FIG. 1.

On the planar surface of the horizontal section 16, as shown in FIGS. 2 and 3, are located two apertures that in combination, allow the holder 10 to enter and lock itself onto the bottle neck 54. One of the apertures, is located nearest the handle end and is referred to as the bottle neck aperture 18. This aperture has a diameter greater than the diameter of the bottle's annular neck flange 56 allowing it to be placed over the bottle neck.

In longitudinal alignment with the bottle neck aperture 18 is the bottle necks locking aperture 22. As best shown in FIGS. 2 and 3, the aperture 22 has a section of its inward circumference that intersects (truncates) a section of the inward circumference of the bottle neck aperture 18. The two intersection points of the aperture 22 form a central angle $\alpha$ in the remaining circumference of the bottle neck locking aperture that is greater than 180-degrees. At each of the intersection points there is located a locking flange projection 24. The distance between the two projections 24 must be less than the diameter of the bottle neck at a point immediately below the bottles annular neck flange. This distance is selected to allow a tight friction fit when the bottle neck locking aperture 22 is forced into the bottle neck 54. The projections 24 are rounded to further facilitate the friction entry into the bottle neck.

The final and third item required to allow the holder to function properly is the annular neck flange channel 26. This channel, as shown in FIGS. 1, 2 and 5 is recessed from the top surface of the horizontal section 16 and is located immediately below the remaining (truncated) circumference of the bottle neck locking aperture. The width and thickness of the channel is selected to allow the channel 26 to encompass and retain the bottles annular neck flange 56 when the bottle neck locking aperture 22 enters and locks itself to the bottle neck.

The basic configuration of the holder can be strengthened by including a front strengthening rib 30, a back strengthening rib 32 and an aperture reinforcing lip 34.

The front strengthening rib 30, as shown in bottom view in FIG. 3 and in side view in FIG. 5, extends centrally from the bottom surface of the horizontal section 16 and partially along the inside surface of the front bottle support 12. The inside longitudinal contour of this rib may be contoured to fit the side contour of the bottle as shown in FIG. 5.

The back strengthening rib 32 as also shown in FIGS. 3 and 5, extends centrally from the bottom surface of the horizontal section 16 and partially along the inside surface of the handle section 14.

The aperture reinforcing lip 34, as shown in FIGS. 3 and 5, is located around the bottom truncated circumference edge of the bottle neck aperture 18 and the bottle neck locking aperture 22. The front and back outer section of the lip 34 is contiguous with the inward tip of the front strengthening lip 30 and an inward tip of the back strengthening rib 32 respectively.

The entire holder 10 with all the elements previously described is preferably integrally formed of a rigid or semi-rigid material. A plastic such as ABS, Phenolic, polyethylene or PVC is preferred.

The reuseable bottle holder 10 is primarily designed to lift, carry or pour from a two-liter bottle. However, the holder is adaptable to any size bottle having a neck that incorporates an annular neck flange. To use the holder, the bottle neck 54 is inserted into the bottle neck aperture 18. Once inside, the bottle 50 is held with one hand and the holder is gently pulled backwards, that is away from the bottle, until the bottle neck locking aperture 22 looks itself into the bottle neck with the annular neck flange channel 26 positioned under the bottle's annular neck flange 56. The holder is then grasped by the handle section 14 and the bottle may be lifted, carried or poured by using only one hand.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

I claim:

1. A reusable bottle holder that attaches to a bottle having a bottle neck that incorporates an annular neck flange, where said holder comprises:

(a) a front bottle support having an upper end and a lower end, (b) a handle having an upper end and a lower end, and (c) a horizontal section including a planar surface having a front end contiguous with the upper end of said front bottle support and a back end contiguous with the upper end of said handle with said horizontal section having on its planar surface:

(1) a bottle neck aperture, located nearest the handle side, having a diameter greater than the diameter of the bottle's annular neck flange, (2) a bottle neck locking aperture longitudinally aligned with said bottle neck aperture and having a section of its inward circumference that intersects with the inward circumference of said bottle neck aperture where at the two intersection points of said bottle neck locking aperture, a central angle is formed by the remaining circumference of said bottle neck locking aperture that is greater than 180-degrees and that terminates in a pair of locking flanges projections dispersed at a distance that is less than the diameter of the bottle neck immediately below the bottle's annular neck flange, and an annular neck flange channel recessed from a top surface of said horizontal section immediately below the remaining circumference of said bottle neck locking aperture where the width and thickness of said channel allows the channel to encompass and retain the bottle's annular neck flange when the bottle neck enters the bottle neck locking aperture.

2. The holder as specified in claim 1 further comprising a front strengthening rib centrally extending from the bottom surface of said horizontal section and partially along the inside surface of said front bottle support.

3. The holder as specified in claim 2 further comprising a back strengthening rib centrally extending from the bottom of said horizontal section and partially along the inside surface of said handle section.

4. The holder as specified in claim 1 further comprising along the bottom plane of said front bottle support a bottle grasping tip.

5. The holder as specified in claim 1 wherein on the inside portion of said handle section is configured with a finger grip contour.

6. The holder as specified in claim 3 further comprising an aperture reinforcing lip located around said bottle neck aperture and said bottle neck locking aperture where the front and back outer section of said lip is contiguous with the inward tip of said front strengthening rib and the inward tip of said back strengthening rib respectively.

7. The front strengthening rib as specified in claim 2 wherein the inside longitudinal contour of said rib is contoured to fit the side contour of a bottle.

8. The holder as specified in claim 1 wherein the lower end of said front bottle support radiused to fit the rounded surface contour of a bottle.

9. The holder as specified in claim 1 wherein the entire holder is integrally formed.

* * * * *